US006609272B1

(12) United States Patent
Lee

(10) Patent No.: US 6,609,272 B1
(45) Date of Patent: Aug. 26, 2003

(54) HINGE DEVICE FOR USE IN ELECTRIC EQUIPMENT

(75) Inventor: Sung Bin Lee, Gumi (KR)

(73) Assignee: Yuk Kwon Lee (KR)

( * ) Notice: Subject to any disclaimer, the term of this patent is extended or adjusted under 35 U.S.C. 154(b) by 0 days.

(21) Appl. No.: 10/120,838

(22) Filed: Apr. 12, 2002

(30) Foreign Application Priority Data

Mar. 14, 2002 (KR) ..... 2002-13965

(51) Int. Cl.[7] ..... E05F 1/08

(52) U.S. Cl. ..... 16/307; 16/342; 16/338; 16/308; 248/919; 248/922; 248/923; 361/681

(58) Field of Search ..... 16/342, 338, 339, 16/340, 367, 368, 308, 235, 307; 248/917, 919, 920, 921, 922, 923; 361/679, 681, 682, 683; 74/490.05, 490.06

(56) References Cited

U.S. PATENT DOCUMENTS 5,195,213 A * 3/1993 Ohgami et al. ..... 16/342
5,967,587 A * 10/1999 Collet et al. ..... 296/97.11
6,145,797 A * 11/2000 Uehara ..... 248/291.1
6,296,215 B1 * 10/2001 McCoy et al. ..... 248/284.1
6,304,433 B2 * 10/2001 O'Neal et al. ..... 361/681
6,347,433 B1 * 2/2002 Novin et al. ..... 16/367
6,467,129 B1 * 10/2002 Bae ..... 16/342
6,532,628 B2 * 3/2003 Kim ..... 16/342

* cited by examiner

*Primary Examiner*—Robert J. Sandy
*Assistant Examiner*—Matthew E. Rodgers
(74) *Attorney, Agent, or Firm*—Liniak, Berenato & White, LLC

(57) ABSTRACT

A hinge device for use in an electric or electronic apparatus is provided, in which a pivoting portion moves with respect to a fixed portion around a hinge portion. Accordingly, the hinge device has effects of a simple assembly and an easy maintenance. Also, the hinge device plays a role of a hinge which can freely adjust a torque transferred to the upper bracket to thus generate a proper frictional force constantly and adjust a rotational angle according to an angle formed by the upper and lower contacting portions of the holder.

1 Claim, 2 Drawing Sheets

HINGE DEVICE FOR USE IN ELECTRIC EQUIPMENT

BACKGROUND OF THE INVENTION

1. Field of the Invention

The present invention relates to a hinge device, and more particularly, to a hinge device connecting a fixed portion and a pivoting portion in electric or electronic equipment in order to rotate in a certain direction, which has effects of a simple assembly and an easy maintenance, and can freely adjust a torque transferred to the rotational axle to thus generate a proper frictional force constantly and adjust a rotational angle according to an angle formed by the upper and lower contacting portions of the holder.

2. Description of the Related Art

In a general hinge device, a pivoting portion moves with respect to a fixed portion around a hinge portion, in-which a predetermined pivoting movement is generated according to the movement of the pivoting portion. In particular, a hinge device used for an electric appliance applies a frictional force to a rotational axle in most cases by using an engagement force formed by adjusting tightening of washers and a bolt at each end of the rotational axle. In this case, the frictional forces applied to both ends of the rotational axle do not equal, and also an external force should be adjusted and applied to both ends of the rotational axle through a complicated procedure.

Also, a separate stopper bracket and a pivoting bracket should be provided in the rotational axle, in order to determine the rotational angle of the pivoting portion. Further, a connection relationship between the rotational axle and the brackets becomes complicated.

As a result, hinge devices for complementing the above problems have been proposed and are being used. However, it is difficult to correct an initially set pivoting torque and an open frictional force. Also, since the structures of the hinge devices are complicated, effectiveness is not being greatly exhibited.

SUMMARY OF THE INVENTION

To solve the above problems, it is an object of the present invention to provide a hinge device for use in electric or electronic equipment, which has effects of a simple assembly and an easy maintenance, and can freely adjust a torque transferred to a rotational axle to thus generate a proper frictional force constantly and adjust a rotational angle according to an angle formed by the upper and lower contacting portions of the holder.

To accomplish the above object of the present invention, there is provided a hinge device for use in electric or electronic equipment in which a pivoting portion moves with respect to a fixed portion around a hinge portion, to thereby generate a predetermined pivoting movement according to the movement of the pivoting portion, the hinge device comprising: a lower bracket; vertical plates which are vertically and opposingly installed with respect to each other on the central portion of the lower plate, each vertical plate having an inwardly protruding stopper on the upper portion thereof; a rotational axle around the center portion of which a coil spring is wound to support the lower bracket and an upper bracket, and around the axle groove of which a snap ring is fitted, the rotational axle being placed across the upper portions of the vertical plates, wherein part of each end of the rotational axle is cut to form a cutting face; a connection plate placed across the upper portions of the vertical plates, the connection plate having a fixing hole and a fixing unit on each end thereof; a band spring having an engagement unit is fitted into each end of the rotational axle, the engagement unit and washers are fixed by a fixing unit and an adjustment bolt, wherein a band cutting face is formed facing the cutting face of the rotational axle; and the upper bracket having two supporters each of which has a holder including an upper contacting portion and a lower contacting portion which contact the protruding stopper respectively and an axle hole through which the rotational axle is fitted, wherein a plate bearing groove in which a plate bearing is inserted and an adjustment hole through which an adjustment bolt is engaged in the inside of the axle hole.

BRIEF DESCRIPTION OF THE DRAWINGS

The above object and other advantages of the present invention will become more apparent by describing the preferred embodiments thereof in more detail with reference to the accompanying drawings in which.

DETAILED DESCRIPTION OF THE INVENTION

Preferred embodiments of the present invention will be described with reference to the accompanying drawings.

Figure 1:
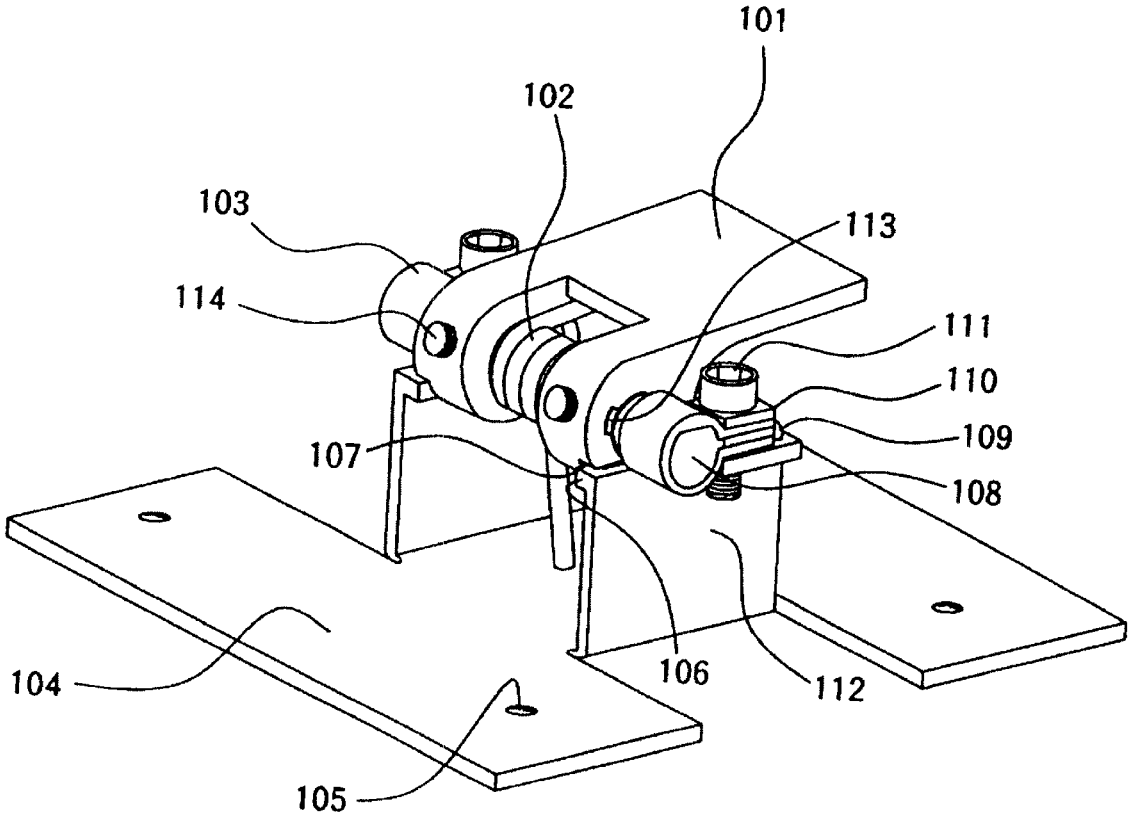
FIG. 1 is a perspective view showing the overall structure of a hinge device of the present invention.
Figure 2:
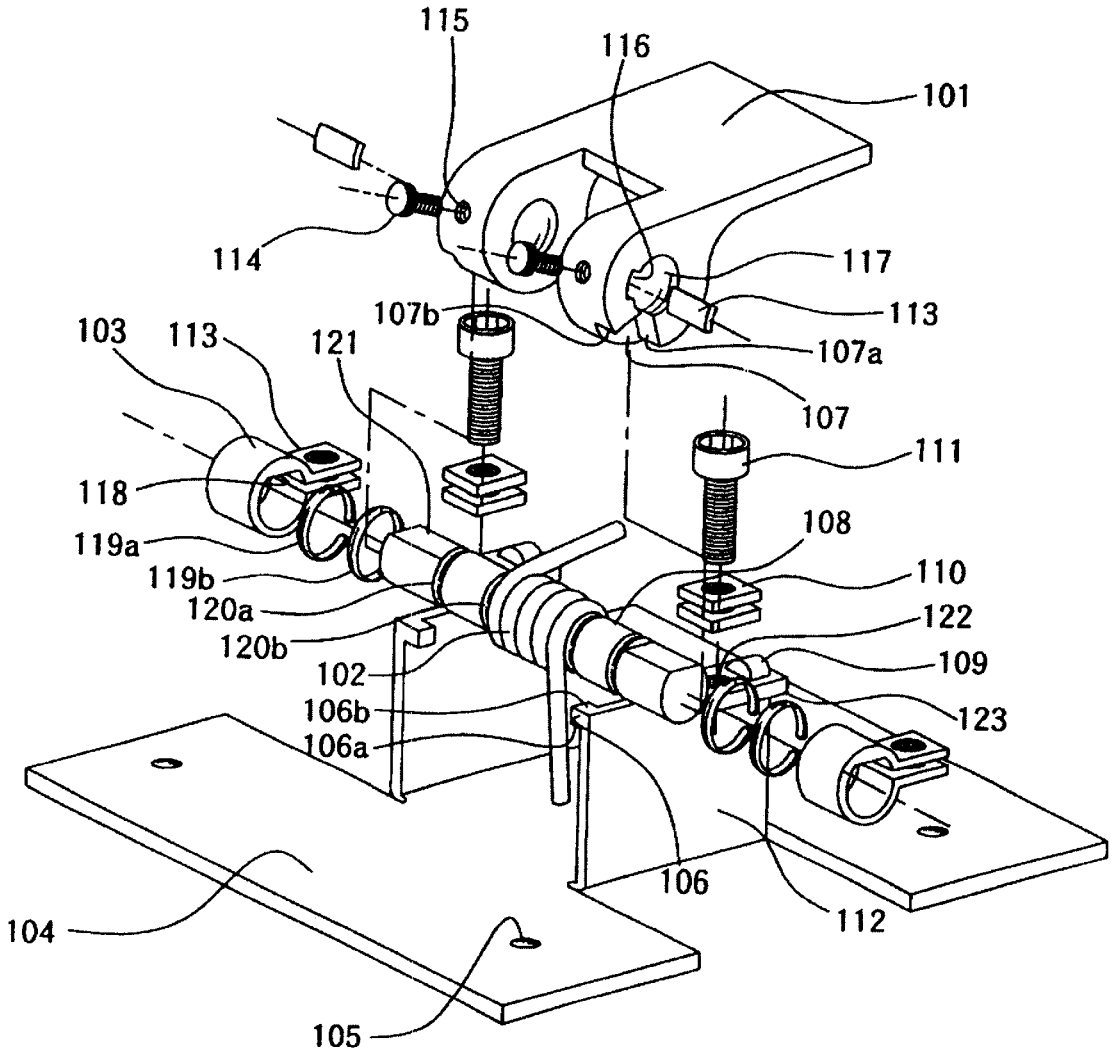
FIG. 2 is an exploded perspective view for explaining the assembly process of the hinge device according to the present invention.

Referring to FIGS. 1 and 2, a hinge device according to the present invention includes a lower bracket 104 which is fixed through fixing holes 105 to a fixed portion (not shown) by means of a general connection structure, and vertical plates 112 formed vertically and opposingly with respect to each other on the central portion of the upper portion of the lower bracket 104, which are integrated with the lower bracket 104. A protruding stopper 106 formed of an upper face 106*b* and a lower face 106*a* is formed on the upper portion of each vertical plate 112. A rotational axle 108 the part of each end of which is cut to form a cutting face 121 is placed across the vertical plates 112, in which a coil spring 102 having a predetermined tension, to support the lower bracket 104 and an upper bracket 101 is wound around the central portion of the rotational axle 108 and snap rings 119*a* and 119*b* are fitted around rotational axle grooves 120*a* and 120*b* formed on each end of the rotational axle 108, in order to prevent the plate bearing 113 from being separated from the plate bearing groove 116. A connection plate 123 formed of a fixing unit 109 and an engagement hole 122 on each end thereof is placed across the vertical plates 112. . A band spring 103 having an engagement unit 113 is fitted into each end of the rotational axle 108, and the engagement unit 113 and washers 110 are fixed by a fixing unit 109 and an adjustment bolt 111. Here, a band cutting face 118 formed in each end of the band spring 103 is formed facing the cutting face 121 formed in each end of the rotational axle 108. The upper bracket 101 having two supporters each of which has a holder 107 including an upper contacting portion 107a and a lower contacting portion 107*b* which contact the upper face 106*b* and the lower face 106*a* of the protruding stopper 106 respectively in the vertical plates 112, a plate bearing groove 116 through which a plate bearing 113 is fitted in an axle hole 117 through which the rotational axle 108 is fitted, and an adjustment hole 115 with which the adjustment bolt 114 is engaged with the plate bearing groove 116 is engaged with a pivoting portion (not shown).

The functions of the hinge device according to the present invention will be described below.

The lower bracket 104 on which the vertical plates 112 are integrated is fixed through fixing holes 105 to a fixed portion (not shown) by means of a general connection structure.

The rotational axle 108 is fixed with an engagement bolt 111 by means of the band cutting faces 118 of the band springs 103 facing the cutting faces 121 formed in the left and right sides of the rotational axle 108.

The coil spring 102 has an elastic force having a predetermined tension. In order to adjust the elastic force, the plate bearings 113 are fitted in the plate bearing grooves 116 formed in the inside of the rotational axle hole 117, respectively, to thereby maintain a constant frictional force during pivoting of the upper bracket 101.

Here, in order to freely adjust the torque transferred to the rotational axle 108 and thus generate an appropriate frictional force constantly, the band spring 103 is adjusted with the adjustment bolt 111, and the snap rings 119*a* and 119*b* are fitted into the axle grooves 120*a* and 120*b* formed in each end of the rotational axle 108.

In order to smoothen the friction with the rotational axle 108, a lubricant such as grease is filled into the axle hole 117.

Two washers 110 or the like are fitted with the engagement bolt 111, in order to prevent the engagement bolt 111 from being loosened. Also, in order to prevent the washers 110 from being idly rotated when the washers 110 are engaged with the engagement bolt 111, the fixing unit 109 is fitted on the upper portion of the connection plate 123.

The coil spring 102 is fitted around the rotational axle 108, and then the rotational axle 108 is inserted into the rotational axle holes 112 formed in the upper bracket 101. Then, the upper bracket 101 is engaged with a pivoting portion (not shown).

When the upper bracket 101 is pivoted by the rotational axle 108, the upper contacting portion 107*a* and the lower contacting portion 107*b* formed in the upper bracket 101 contact the upper face 106*b* and the lower face 106*a* of the protruding stopper 106 formed in the vertical plate 112 respectively, to thereby maintain a predetermined rotational angle.

The lower contacting portion 107*b* contacts the upper face 106*b* by the elastic force of the coil spring 102 unless the upper bracket 101 is pivoted.

When the upper bracket 101 is pivoted downwards, a force is applied to offset the elastic force of the coil spring 102 and the frictional force of the plate bearing 113, both of which are wound around the rotational axle 108. In this case, the upper bracket 101 is pivoted downwards by the frictional force of the band spring 103 wound around the rotational axle 108. Here, the upper bracket 101 is smoothly pivoted downwards due to the elastic force of the coil spring 102 formed on each end of the rotational axle 108, and stopped at the time when the lower contacting portion 107*b* of the upper bracket 101 contacts the upper face 106*b* of the stopper 106 in the vertical plate 112.

Also, when the upper bracket 101 is pivoted upwards, a force is applied to offset the elastic force of the coil spring 102 and the frictional force of the plate bearing 113, both of which are wound around the rotational axle 108. In this case, the upper bracket 101 is pivoted upwards by the elastic force of the coil spring 102 wound around the rotational axle 108. Here, the upper bracket 101 is smoothly pivoted upwards due to the frictional force of the plate bearing 113 formed on each end of the rotational axle 108, and stopped at the time when the upper contacting portion 107*a* of the upper bracket 101 contacts the lower face 106*a* of the stopper 106 in the vertical plate 112.

As described above, it is preferable that the holder 107 formed of the upper contacting portion 107*a* and the lower contacting portion 107*b* has a groove of a predetermined thickness for each kind of electric or electronic equipment, so that the upper bracket 101 is easily pivoted.

As described above, the hinge device according to the present invention has effects of a simple assembly and an easy maintenance, and can freely adjust a torque transferred to the rotational axle to thus generate a proper frictional force constantly and adjust a rotational angle according to an angle formed by the upper and lower contacting portions of the holder.

The present invention is not limited to the above-described embodiments. It is apparent to one who has an ordinary skill in the art that there may be many modifications and variations within the same technical spirit of the invention.

What is claimed is:

1. A hinge device for use in electric or electronic equipment in which a pivoting portion moves with respect to a fixed portion around a hinge portion, to thereby generate a predetermined pivoting movement according to the movement of the pivoting portion, the hinge device comprising:

a lower bracket;

vertical plates which are vertically and opposingly installed with respect to each other on the central portion of a lower plate, each vertical plate having an inwardly protruding stopper on the upper portion thereof;

a rotational axle around the center portion of which a coil spring is wound to support the lower bracket and an upper bracket, and around an axle groove of which a snap ring is fitted, the rotational axle being placed across the upper portions of the vertical plates, wherein part of each end of the rotational axle is cut to form a cutting face;

a connection plate placed across the upper portions of the vertical plates, the connection plate having a fixing hole and a fixing unit on each end thereof;

a band spring having an engagement unit, which is fitted into each end of the rotational axle, the engagement unit and washers are fixed by a fixing unit and an adjustment bolt, wherein a band cutting face is formed facing the cutting face of the rotational axle; and the upper bracket having two supporters each of which has a holder including an upper contacting portion and a lower contacting portion which contact the protruding stopper respectively and an axle hole through which the rotational axle is fitted, wherein a plate bearing groove in which a plate bearing is inserted and an adjustment hole through which an adjustment bolt extends are engaged in the inside of the axle hole.

* * * * *